US005203158A

United States Patent [19]

Bowers

[11] Patent Number: 5,203,158

[45] Date of Patent: Apr. 20, 1993

[54] ROLLER CHAIN ASSEMBLING AND DISASSEMBLING DEVICE

[76] Inventor: Charles E. Bowers, 576 E. 152nd St., Cleveland, Ohio 44110

[21] Appl. No.: 783,985

[22] Filed: Oct. 29, 1991

[51] Int. Cl.[5] ..... B21L 21/00

[52] U.S. Cl. ..... 59/7

[58] Field of Search ..... 59/7, 8, 35.1; 72/454

[56] References Cited

U.S. PATENT DOCUMENTS

| | | | |
|---|---|---|---|
| 1,000,867 | 8/1911 | Widmayer et al. | 59/7 |
| 1,445,326 | 2/1923 | Krebs | 59/7 |
| 2,622,389 | 12/1952 | Sjostrom et al. | 59/7 |
| 2,783,611 | 3/1957 | Simpkin et al. | 59/7 |
| 3,233,402 | 2/1966 | Urbaitis | 59/7 |
| 3,234,634 | 2/1966 | Johnson et al. . | |
| 3,553,960 | 1/1971 | Ellefson | 59/7 |
| 4,394,810 | 7/1983 | Womble | 59/7 |
| 4,833,875 | 5/1989 | Buermonn, Jr. et al. | 59/7 |

FOREIGN PATENT DOCUMENTS

| | | | |
|---|---|---|---|
| 148715 | 8/1920 | United Kingdom | 59/7 |
| 180458 | 6/1922 | United Kingdom | 59/7 |

*Primary Examiner*—David Jones
*Attorney, Agent, or Firm*—Jane M. Marciniszyn

[57] ABSTRACT

A device for inserting and/or removing pins from a roller chain includes a block having a cradle for immobilizing and temporarily holding a roller chain together while pins are being inserted or removed. The device has a pair of threaded bores aligned with a pin or pin opening of a roller chain received in the cradle, one threaded bore carries a screw having a ram portion operable to positively force a pin from the roller chain, the other threaded bore carries a screw operable to positively force a pin into the roller chain.

10 Claims, 6 Drawing Sheets

ROLLER CHAIN ASSEMBLING AND DISASSEMBLING DEVICE

BACKGROUND OF THE INVENTION

1. Field of the Invention

The invention relates generally to a manually operable tool for assembling and/or disassembling a roller chain such as a drive chain for bicycles, motor vehicles, motor driven tools, and the like, and more particularly relates to a compact manually operable tool for removing and/or inserting pins into a roller chain.

2. Description of Related Art

Drive chains are frequently used for the transmission of power, and for timing or synchronizing motions. A principal advantage of chain drives is that they provide efficient positive drive and power capacity. Roller chains are particularly efficient and economical at transmitting power because of the ability of the rollers to rotate when contacting sprocket teeth.

The various components of a roller chain can become damaged or stretched during use, requiring disassembly of the chain, removal or replacement of chain components and reassembly. Because of their design, roller chains cannot be readily repaired with ordinary tools and, consequently, specialized tools for disassembling and reassembling roller chains are a practical necessity.

The disassembly and assembly of drive chains of various types has been an ongoing problem and various tools have been developed for this purpose.

U.S. Pat. No. 1,000,867 to Widmayer et al. shows a device for removing pins from chains. The device has a block-shaped head with two projections which extend through the openings in a chain, which normally receive the teeth of a sprocket wheel. An adjacent projection has a threaded bore for a screw with a pointed end which engages the pin associated with the roller held between the two projections. The screw can be turned to partially force the rivet from the chain, and a punch is then used with a hammer to completely remove the rivet from the chain.

A disadvantage of the device disclosed by the Widmayer et al. patent is that it does not provide a means for positively driving the rivet completely out of the chain, nor does it provide means for inserting a new rivet. Another disadvantage is that the outer surfaces of the outer link plates are unsupported, which might tend to subject them to deformation forces.

U.S. Pat. No. 1,445,326 to Krebs shows a device for separating and repairing chains similar to that of the Widmayer et al. patent. It differs in that an ejector affixed to the screw member is turned to force the pin out of the links, bending the outer link plate outwardly, freeing the pin from the lower links and permitting the roll to be removed. No hammering motion is required, however, the bent outer link plate must be repaired before being reused or, more likely, simply discarded.

The device disclosed by Krebs has the disadvantages of damaging the outer link plate, and, as with the Widmayer et al. device, does not provide means for inserting a new pin.

In U.S. Pat. No. 4,394,810 to Womble, a device is shown which comprises a combination vise and breaker pin for facilitating repair of metal drive chains. The vise serves to pull the links of a chain together so that tension is maintained throughout the chain while links between jaws become loose and readily repairable. This feature is combined with a breaker pin moving within a hollow channel axial of a full thread hexhead bolt. In operation, the breaker pin cooperates with a U-shaped cradle suitable for holding a link. The bolt carrying the breaker pin is then tightened against the chain link bearing pin. A bearing push bolt is then advanced through a threaded channel so that the breaker head is brought into contact with one of the pins in the roller chain. If the pin of the roller chain resists the force being applied to remove the pin, a sharp rap by a hammer should be utilized.

From the disclosed design of the Womble device, it is apparent that the pin removal and vise operate independent of one another. The device, therefore, is not capable of holding a chain together during the removal of a pin. Another disadvantage is that the device is not always capable of positively forcing a pin from a chain, but instead relies on the use of a hammer applied to the breaker pin.

While it is suggested in the Womble patent that the impeller bolt may be used for inserting a new pin and for reconnecting the chain, it is not clear from the disclosure how this is to be accomplished. The Womble device, therefore, does not appear to provide means for positively forcing a pin into a chain.

In U.S. Pat. No. 4,833,875 to Buermann, Jr. et al., a device for assembling a master link with the ends of a roller chain is shown. A movable plate between two stationary end plates has aperture for receiving the ends of the master link pins. The movable plate is moved against the master link pins by rotating a screw threaded member and thereby inserting the two pins.

The Buermann, Jr. device does not disclose means for removing pins from a chain, nor does it disclose means for temporarily holding the chain together.

In U.S. Pat. No. 3,233,402 to Urbaitis, a power saw chain breaker and repair tool is shown. The device includes a rivet extractor which consists of an extending arm in which are adjustably mounted a pair of anvils. To remove a rivet from a link, the anvils are set to support the link and a punch is brought against the face of the rivet. By rotating a stud, the rivet is pushed from the chain. The device also includes separate features for repairing rivets and for forming a new rivet head.

The Urbaitis device has the disadvantage of not providing means for inserting pins or rivets into a chain.

Thus, while various devices are known for inserting and removing rivets or pins from roller chains, a simple, easy to use device, capable of holding a roller chain together during removal and/or insertion of pins, and capable of both inserting and removing pins from the chain without damaging components of the chain, would be highly desirable.

SUMMARY OF THE INVENTION

The invention provides a simple, easy to use, handheld, manually operated device for inserting and/or removing pins from a roller chain. The device comprises a block having a cradle formed to snugly receive a segment of a roller chain including a plurality of chain links. A plurality of teeth projecting from the bottom of the cradle are provided to temporarily hold the chain together during removal or insertion of a pin. Two separate bores extending through the block perpendicularly to the cradle are provided. One bore carries a first reciprocating member for positively forcing pins from the chain and the other bore carries a second reciprocating member for positively forcing pins into the chain.

By including separate means for positively forcing a pin from a roller chain and for positively forcing a pin into a roller chain, a versatile chain repair tool which overcomes many of the disadvantages of the prior art has been provided. Additional disadvantages in the prior art are overcome by providing a cradle which can temporarily hold the chain together during repair of the chain.

A roller chain is easily inserted into the cradle, so that the teeth project through the open areas between the rollers which normally receive the teeth of a sprocket wheel, thereby sufficiently supporting and immobilizing the chain during pin removal or insertion so as to temporarily hold the chain together and to reduce the risk of deformation of chain components. To remove a pin from a chain, the chain is first inserted into the cradle with the pin to be removed in alignment with the first reciprocating member. The first reciprocating member is then operated to positively force the pin from the chain. To insert a pin into the chain, a pin is interposed between a roller chain held by the cradle and the second reciprocating member. The second reciprocating member is then operated to positively force the pin into the chain.

DESCRIPTION OF THE PREFERRED EMBODIMENT

Figure 1:
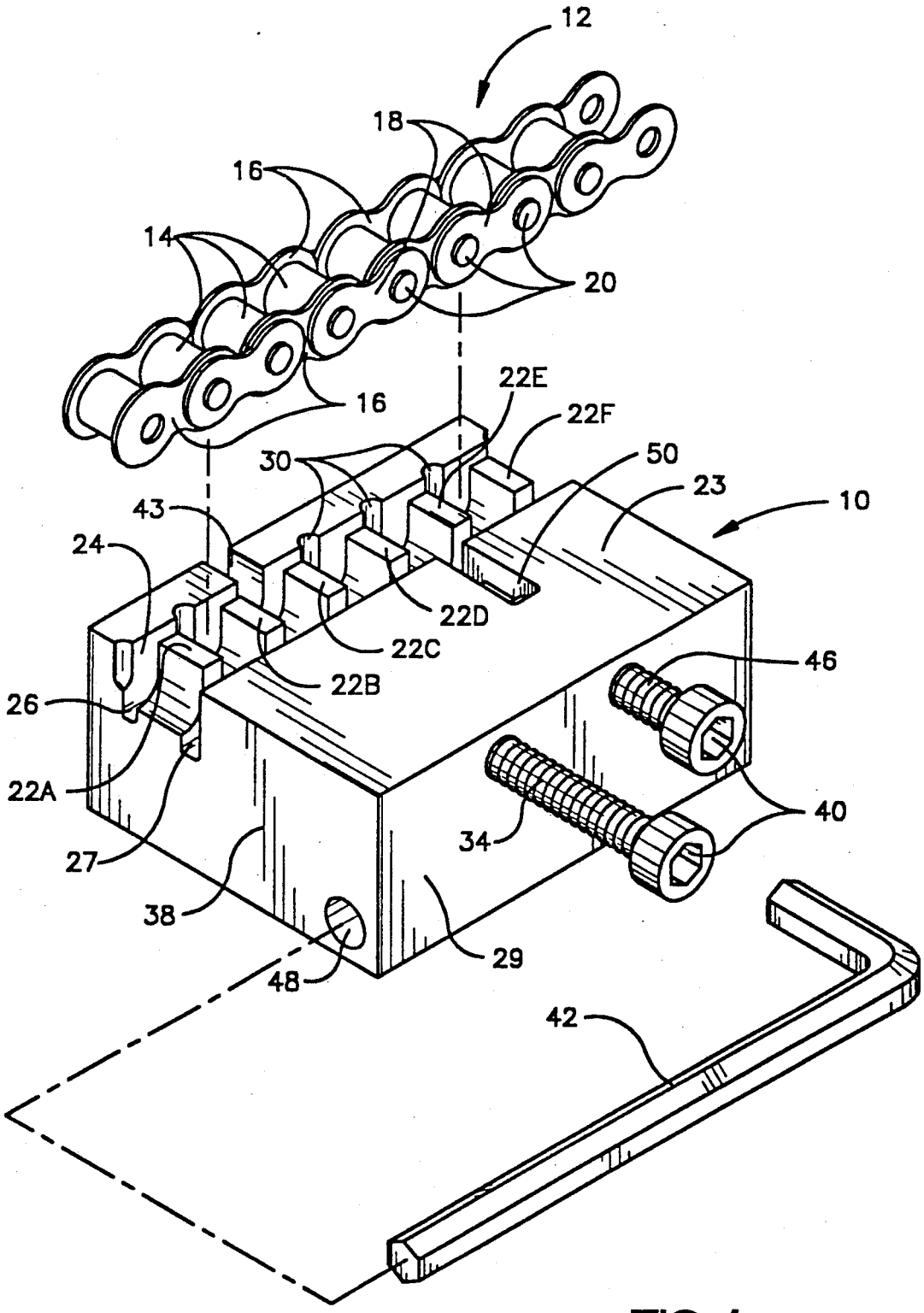
FIG. 1 is a perspective view of a device for removing and/or inserting pins into a roller chain, according to one embodiment of the invention.

In FIG. 1 there is shown a preferred embodiment of a device 10 for assembling and/or disassembling a conventional roller chain 12.

The roller chain 12 is comprised of a plurality of cylindrical rollers 14 having bores along their axes, a plurality of inner link plates 16, a plurality of outer link plates 18, and a plurality of pins 20 connecting the chain components together. Within the axial bore of each roller 14 is a cylindrical bushing (not shown) having an outer bearing surface. Each bushing has a narrow bore or pin opening along its cylindrical axis which is in close tolerance with the diameter of a pin 20. A pin 20 fits tightly within the narrow bore of each bushing so that the pin is immobile with respect to the bushing. The inner surface of the roller 14 slides around the outer surface of the bushing permitting the roller to rotate about the bushing during use. The rollers 14 are arranged colinearly with their axes parallel to one another and perpendicular to the length of the chain 12. The inner link plates 16, in combination with the pins 20, fix the rollers 14 into adjacent pairs which are translationally immobile with respect to one another, while the outer link plates 18, in combination with the pins 20, fix the pairs of rollers together and permit the rotation of one pair of rollers with respect to an adjacent pair of rollers. The rollers are spaced apart from one another in the chain to receive the teeth of a sprocket wheel during normal use.

The device 10 has an overall block or rectangular prism shape. A cradle for holding the roller chain 12 in place during operation of the device extends longitudinally across the top face 23 of the device 10. The cradle has a shape substantially conforming to that of the roller chain. Substantially vertical opposing side walls 24 and 25, flat-bottomed gutters 26 and 27 adjacent to each side wall, and a plurality of upwardly projecting teeth 22A–22F define the cradle. The teeth 22A–22F are formed to project upwardly through the spaces between the rollers 14.

The cradle is formed so that the outer surface of the outer link plate 18 through which a pin 20 is to be removed is firmly and nearly completely supported by the abutting wall 24, thereby effectively countering forces which would otherwise tend to deform the outer link plate through which a pin is forced from the other side.

As shown in FIGS. 3–6, the gutter 26 nearest the back face 28 is dimensioned to tightly accommodate the inner link plates 16 and the abutting outer link plates 18 on one side of the chain. The gutter 27 nearest to the front face 29 is slightly wider than the gutter 26 in order to leave some space between the outer link plates 18 and the sidewall 25. The sides of each tooth 22 are flat and parallel to the channel sidewalls 24 and 25.

The top of each tooth 22 is a rectangular surface coplanar with the top face 23 of the device. Each of the interior teeth 22B, 22C, 22D and 22E are connected to an adjacent tooth by a U-shaped surface having a rounded bottom with a radius slightly larger than that of the rollers 14 so as to be in contact with the bottom half of each roller of the chain through which the interior teeth project when the chain is inserted into the cradle. The outer surfaces of each of the outer teeth 22A and 22F have a half-U-shaped surface which contacts the inner half of the bottom half of the two outer rollers adjacent a single tooth.

Figure 2:
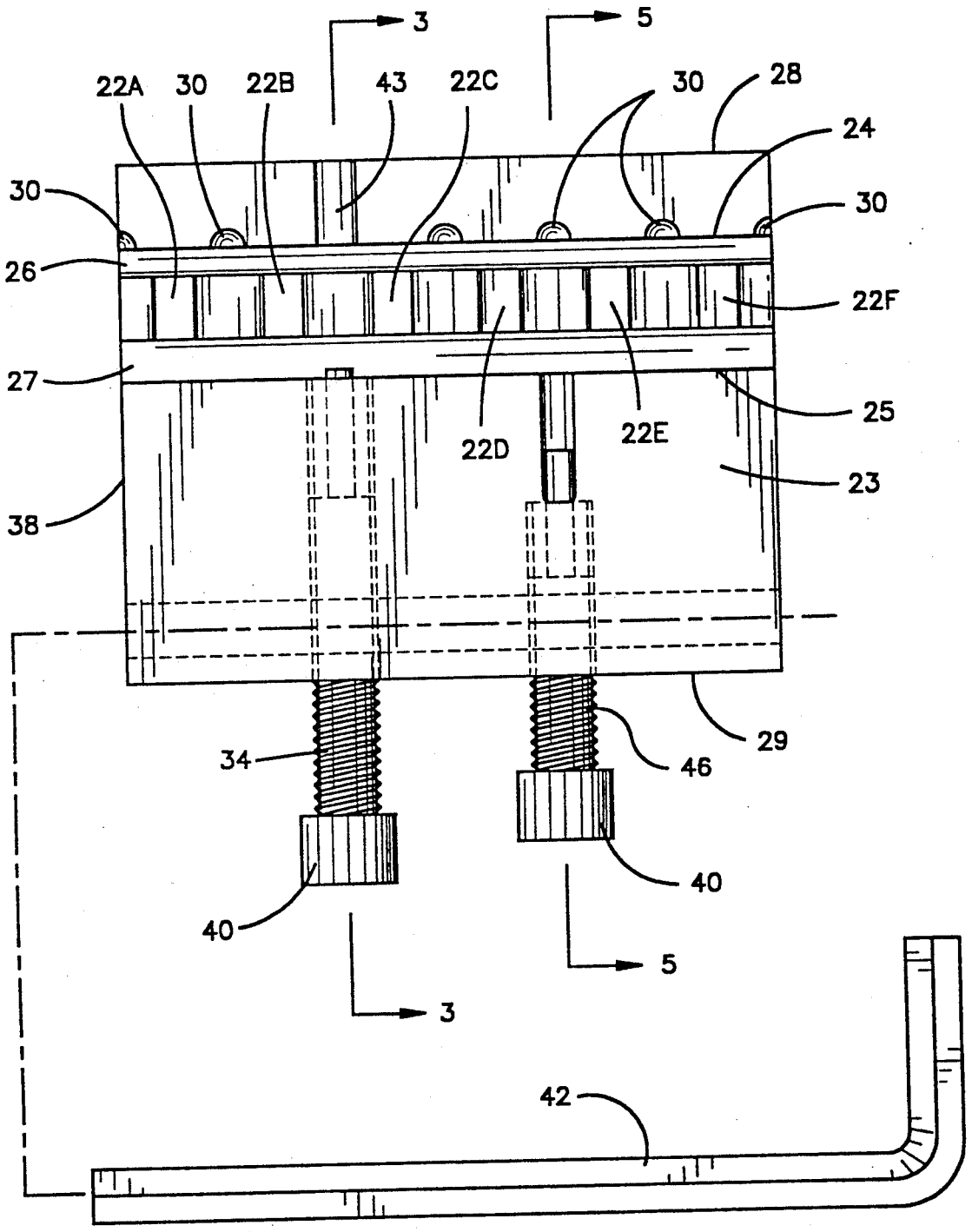
FIG. 2 is a top plan view of the device shown in FIG. 1.
Figure 4:
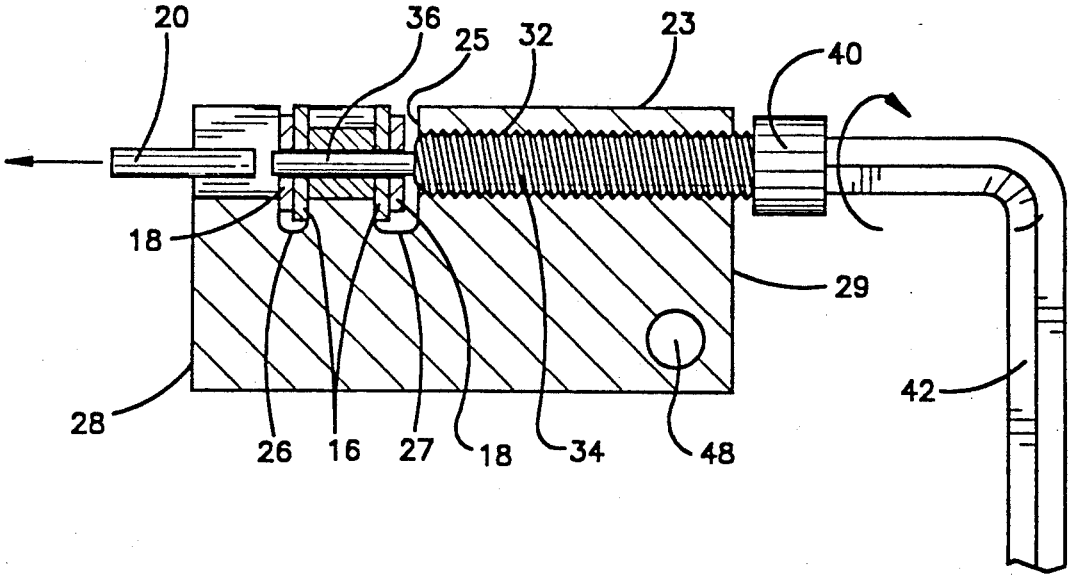
FIG. 4 is a cross section 3—3 from FIG. 2, showing the device immediately after a pin is forced from a chain.
Figure 3:
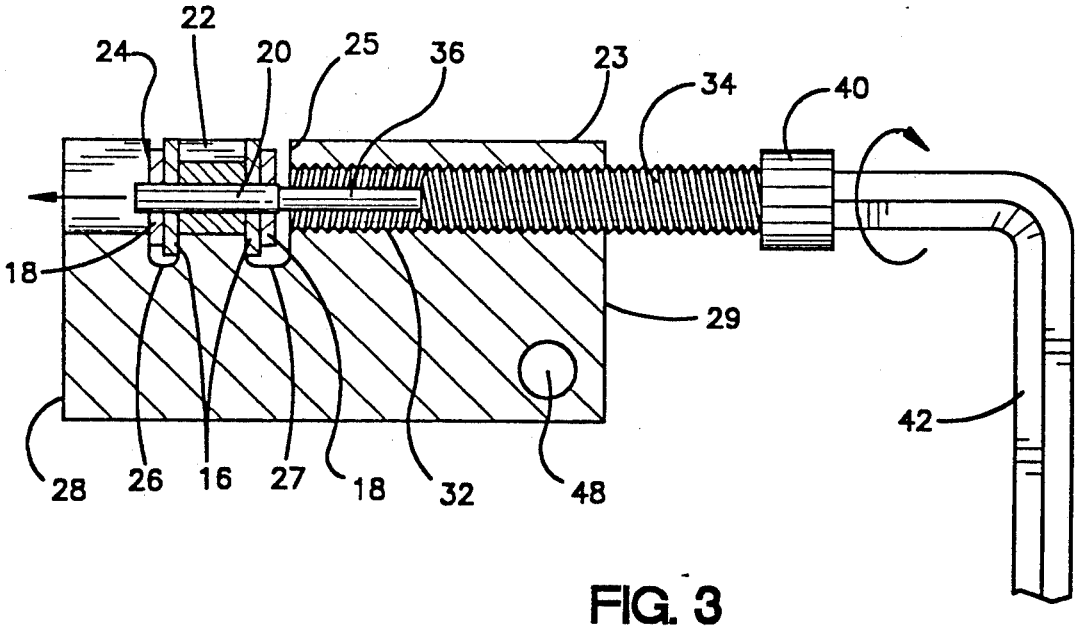
FIG. 3 is a cross section 3—3 from FIG. 2, showing the device immediately before a pin is forced from a chain.
Figure 6:
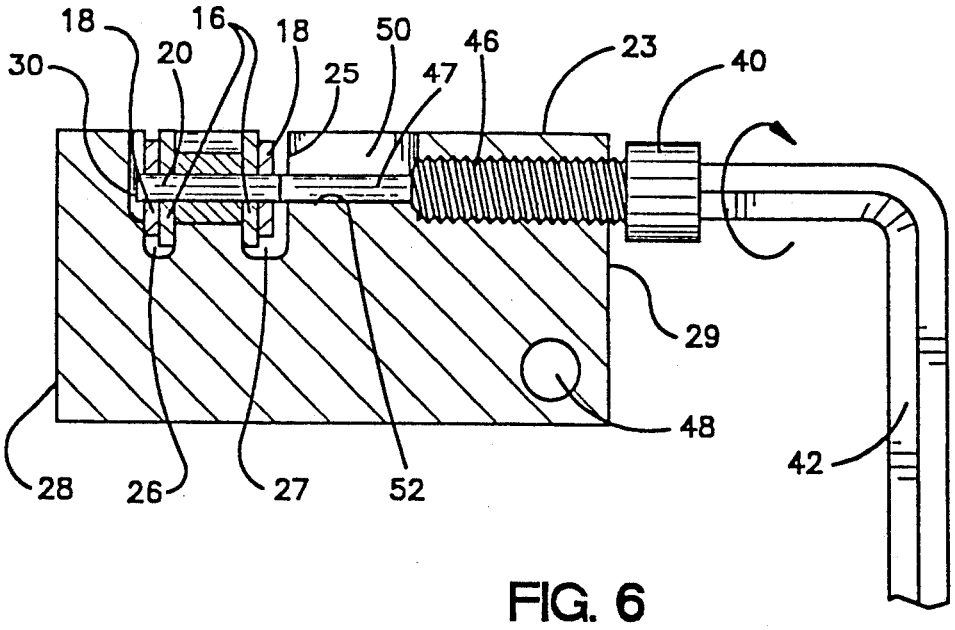
FIG. 6 is a cross section 5—5 from FIG. 2, showing the device immediately after a pin has been inserted into a chain.
Figure 5:
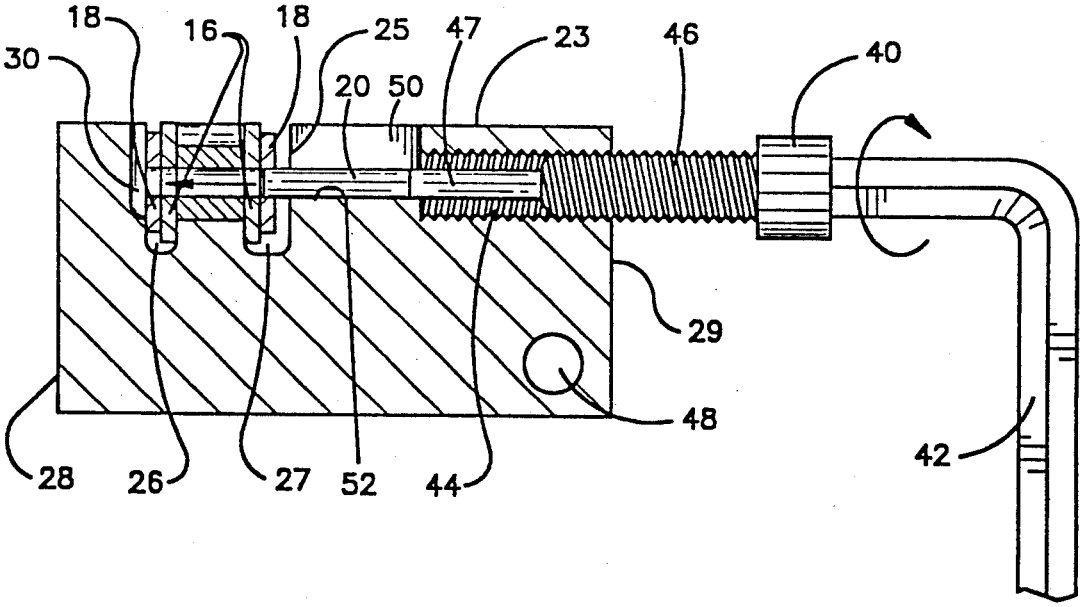
FIG. 5 is a cross section 5—5 from FIG. 2, showing the device immediately before a pin is inserted into a chain.

Because the spacing between the teeth 22 and the sidewall 24 closest to the back face 28 of the device 10 is sized to snugly accommodate the link plates 16 and 18, and because the pins 20 project outwardly from the chain slightly beyond the outer surface of the outer link plates 18, notches 30 (best shown in FIGS. 1 and 2) are provided to accommodate the pins.

A first threaded bore 32 extends through the front face 29 of the device 10 to the sidewall 25 and is coaxial with a pin 20 of a roller 14 between the second 22B and the third 22C teeth from the left face 38 of the device 10. A screw 34 for removing pins 20 has a coaxial cylindrical ram portion 36 extending from the front end of the screw 34 facing the cradle and is carried in the threaded bore 32. The ram 36 has a diameter slightly smaller than the diameter of a pin 20. The screw 34 has a head 40 with a hexagonal socket for receiving the end of an allen wrench 42. A slot 43 or opening is provided to permit the pin to be forced out through the back face 28 of the device.

A second threaded bore 44 is coaxial with a pin opening of a roller 14 held between the forth 22D and fifth 22E teeth from the left face 38 of the device 10. The threaded bore 44 extends from the front face 29 of the device 10 to a groove 52 which in turn extends to the sidewall 25. The groove 52 has a length approximately equal to that of a pin 20 and is formed to hold a pin 20 in precise alignment with the pin opening. The groove 52 is externally accessible through an opening 50 in the top face 23 of the device 10.

A second screw 46 for inserting pins, has a ram portion 47 with a flat or slightly concave front end facing the cradle and is carried in the threaded bore 44. The screw 46 also has a head 40 with a hexagonal socket for receiving the end of an allen wrench 42.

In accordance with the embodiment of FIG. 1, an opening 48 has been provided to store the allen wrench 42 while it is not being used. The wrench is stored in the opening by inserting the long end of the allen wrench into the opening. A spring clip may also be provided at the side of the block near the opening to hold the wrench in place during storage.

In order to remove a pin 20 from a roller chain 12, the screws 34 and 46 are first backed out sufficiently so that no portion of the screws extend past the sidewall 25 into the cradle. The chain 12 is then placed into the cradle so that the roller 14 from which a pin 20 is to be removed is held between the second and third teeth from the left face 38 of the device 10. The screw 34 having ram 36 on its end is then rotated to cause the ram to engage the end of the pin 20 and positively force the pin from the chain. The pin emerges from the chain through a slot 43 in the back face 28 of the device.

To insert a pin into a roller chain using the device, the chain 12 is placed into the cradle of the device with the components to be linked properly arranged so that the holes of the outer link plate 18, the holes of the inner link plate 16, and the narrow bore of a bushing received within a roller 14 are in alignment and placed between the fourth tooth 22D and the fifth tooth 22E. A slot 50 or opening is provided to permit a pin 20 to be placed on a groove 52 which precisely aligns the pin with the pin opening of the chain placed in the cradle. The pin 20 is then positively forced into the chain by turning the screw 46.

The device is provided with six teeth 22A–22E so that a roller pair, comprising two rollers connected to one another by a pair of inner link plates 16, from which a pin 20 is to be removed or inserted and a roller pair on each side thereof are supported by the cradle.

In order to facilitate ease of use, it is desirable that the pin insertion screw 46 be spaced from the pin extraction screw 34 by a distance sufficient to minimize interference and to provide a stronger, more durable structure. In the embodiment of FIG. 1, this is accomplished by providing an additional tooth 22C between the screws 34 and 46. While it is possible to design the device so that the screws are on opposite sides of the cradle, it is not desirable to do so since this would result in a larger design which would be needed to accommodate a threaded bore having a sufficient number of threads of adequate strength to withstand the forces required to insert or remove a pin from a roller chain.

While it is possible to use either more or fewer teeth than is shown in the figures, six teeth are preferred to meet the above objectives in a compact design.

The device can be made in an assortment of sizes to accommodate various size roller chains.

A second embodiment of the invention, shown in FIGS. 7–10, includes a device 10' having a channel into which a cradle-insert 62 is fitted. In accordance with the second embodiment, several different cradle inserts can be provided and used with a single device 10'.

Figure 7:
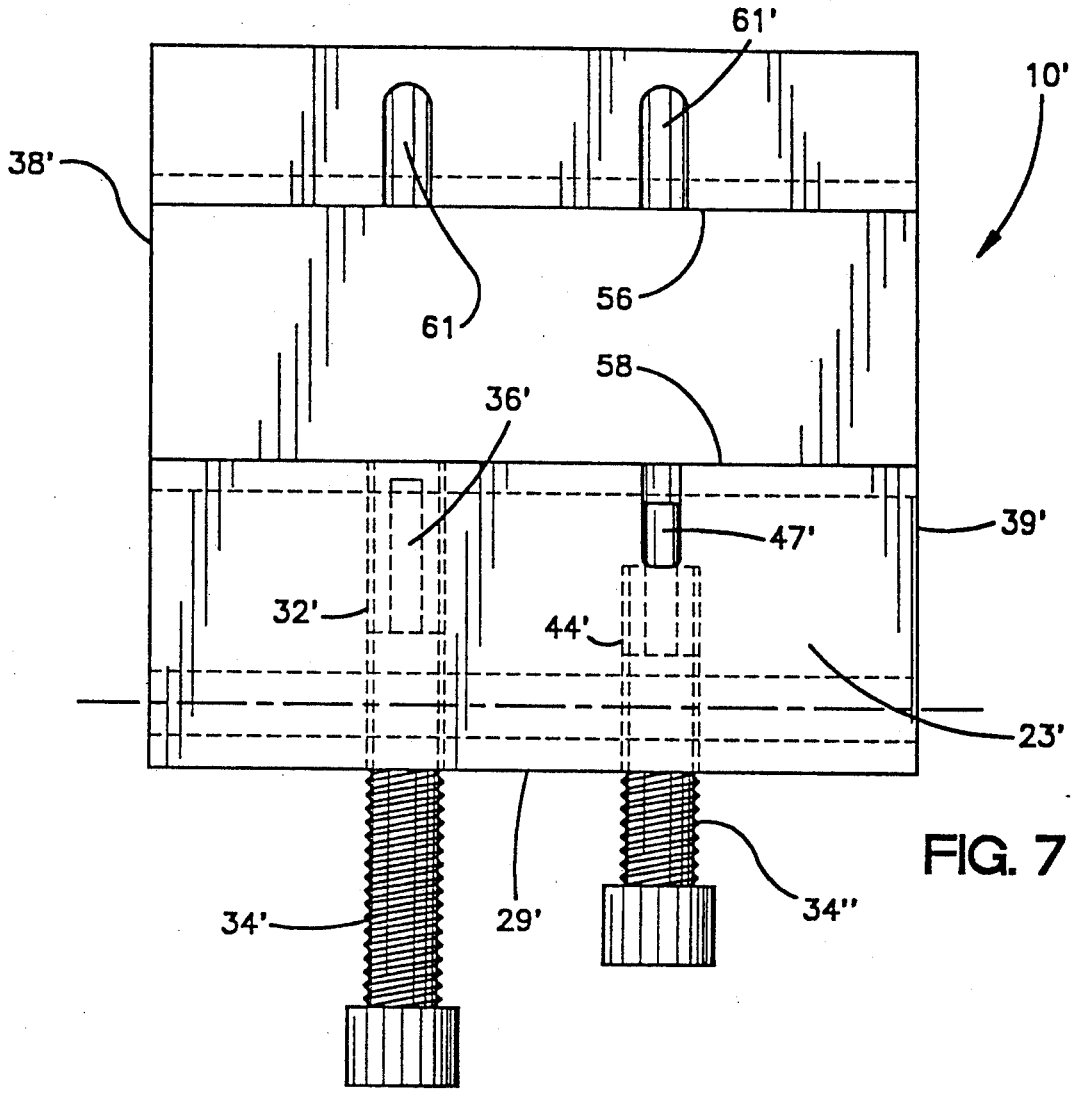
FIG. 7 is a top plan view of a second embodiment of the invention for removing pins from different sized roller chains.
Figure 8:
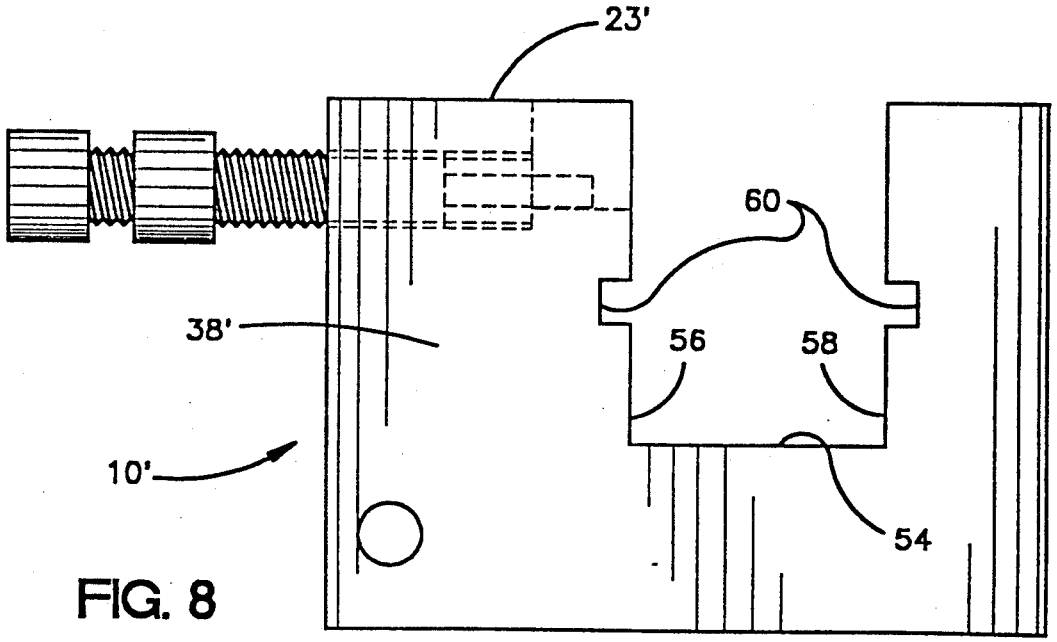
FIG. 8 is left side elevation view of the device shown in FIG. 7.

The device 10', shown in FIGS. 7 and 8, has a channel which extends from the left face 38' of the device to the right face 39', across the top face 23'. The channel has a flat bottom 54 and two sidewalls 56 and 58, each of which extends upwardly from the bottom 54 to the top face 23'. Each sidewall 56 and 58 is perpendicular to the bottom 54 and has a groove 60 (shown in FIG. 8) which extends from the left face 38' to the right face 39' at a fixed distance from the bottom 54.

The device 10' has a first threaded bore which extends through the front face 29' of the device 10' to the channel sidewall 58. A screw 34' for removing pins of a certain size of chain or range of sizes of chains has a coaxial cylindrical ram portion 36' and is carried in the first threaded bore 32'. A second threaded bore 44', parallel to the first also extends from the front face 29' to the sidewalls 58. A second screw 34'', for removing pins from a different size chain or different range of sizes of chains than that of the first screw 34', has a coaxial cylindrical ram portion 47' and is carried in the second threaded bore.

The device 10' has two slots 61 and 61' through which pins removed from a roller chain are ejected.

Figure 9:
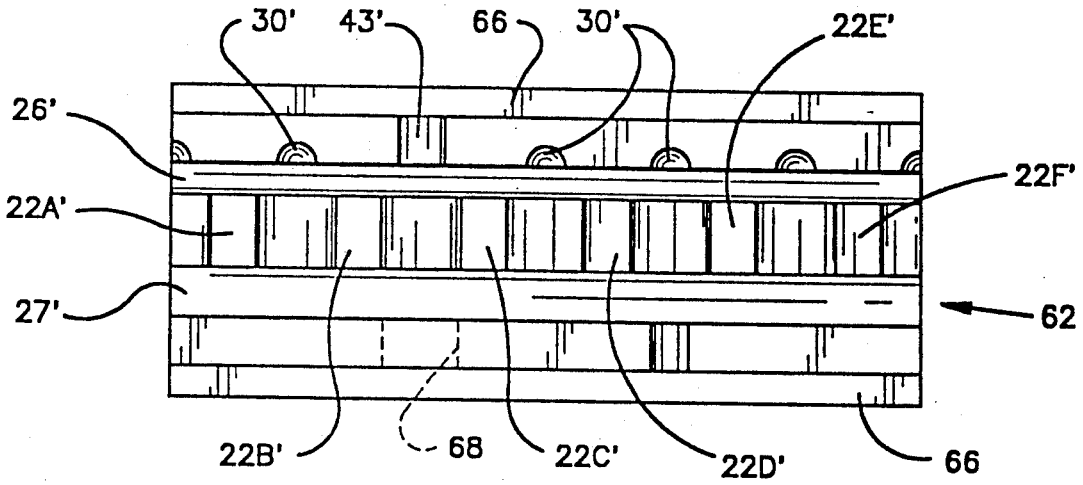
FIG. 9 is a top plan view of a cradle-insert for the device shown in FIGS. 7 and 8.
Figure 10:
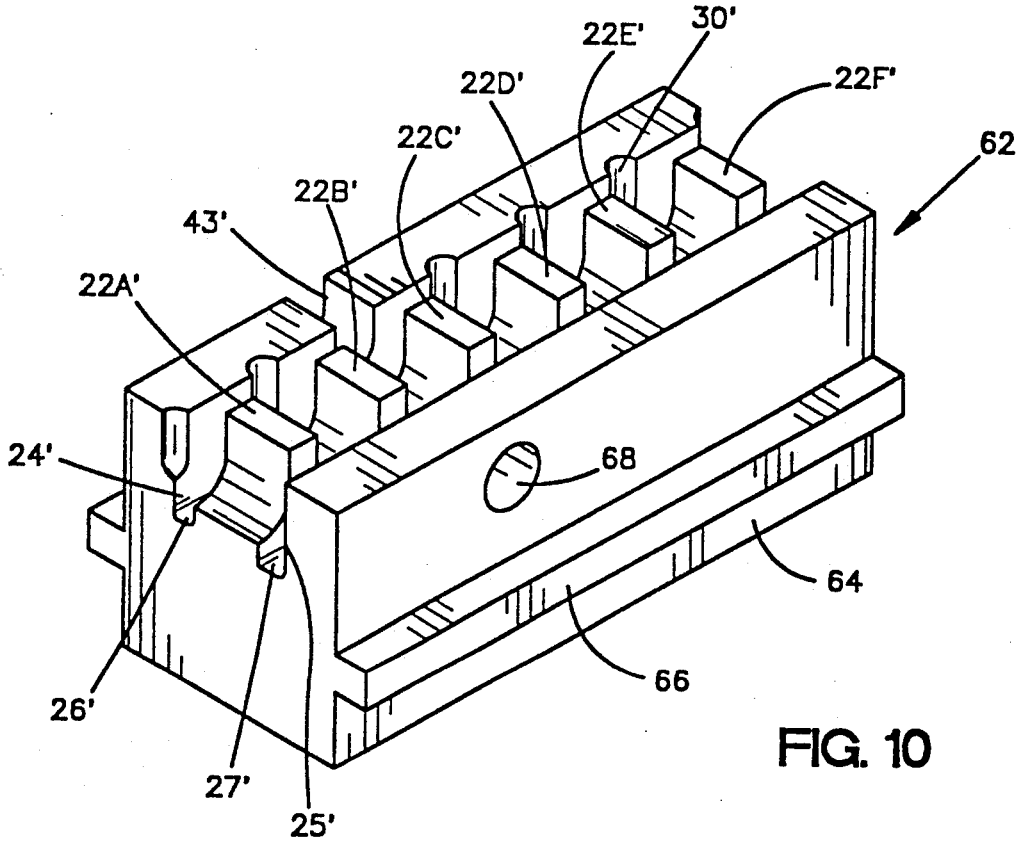
FIG. 10 is a prospective view of the cradle insert shown in FIG. 9.

A removable cradle-insert 62 which fits into the channel of device 10' is shown in FIGS. 9 and 10. The cradle-insert 62 has parallel outer side walls 64 which are spaced part so that the cradle-insert 62 fits snugly into the channel of the device 10'. Each side wall 64 of the cradle-insert 62 has a rib 66 which fits into the grooves 60 to restrict movement of the cradle insert relative to the device 10' when the cradle-insert is inserted into the channel. Additional and/or alternative means for suitably locking the cradle-insert 62 into the device 10' can be provided. Such locking means include stops, latches or screws.

A cradle having a shape generally complementary to that of a roller chain is formed in the cradle-insert 62 to hold a roller chain in place during operation of the device 10'. The cradle is substantially identical to that of the first described embodiment and includes opposing sidewalls 24' and 25', gutters 26' and 27', teeth 22A'–22F', opening 43' and notches 30'. A variety of cradle-inserts, each having a cradle formed to accommodate a different sized roller chain, yet each having an overall size and shape adapted to fit snugly into a single device 10' can be provided to eliminate the need for a completely different device for removing pins from each size roller chain.

Depending on the size of the pin to be removed from a roller chain, the opening 43' is centered either between teeth 22B' and 22C' or between teeth 22D' and 22F'. Each cradle insert also has a second opening 68 aligned between the opening 43' and either the first 34' or second 34'' screw to allow the ram portion of the screw to project into the cradle to force a pin out of a roller chain held in the cradle. Also aligned with the axis of screws 34' and 34'' are slots 61 and 61' respectively, through which pins removed from a roller chain are ejected.

After a cradle-insert having a desired cradle size has been completely inserted into the device 10' and locked in place, operation of the device 10' is substantially identical to that of the first described embodiment.

Various modifications of the device 10' and cradle-insert will be obvious to those skilled in the art. Such obvious adaptions include devices with interchangeable cradle-inserts adopted to positively insert pins into different sized roller chains, as well as devices adapted to either insert or remove pins from various sized roller chains.

The device can be made from any hard, durable material capable of withstanding the forces required to insert a pin and to remove a pin from a roller chain. The device can be machined from steel or other hard metals or alloys, however, strong thermoplastic materials are preferred because of their light weight and because they can be inexpensively machined and/or injection molded.

While the presently preferred embodiments of the invention have been described in detail, these descriptions are not to be regarded as limiting the scope of the invention, since various modifications will be obvious to those skilled in the art.

The block or frame of the device may assume a variety of different shapes and need not be a right rectangular prism. Octagonal prisms and truncated pyramids are examples of block shapes which would be suitable for the invention.

While the screw heads have been shown with octagonal sockets for receiving an allen wrench, various other screw heads, such as slotted, fluted socket, cross recess, square, slotted spanner, or drilled spanner head screws are also suitable.

Obviously, means other than a screw and threaded bore may be used for positively forcing a pin into or from a roller chain without departing from the scope of the invention. Such means include a lever operated plunger.

It should be understood that other modifications and rearrangements may be resorted to without departing from the scope of the invention as disclosed and claimed herein.

What is claimed is:

1. A device for removing pins from a roller chain, comprising:

a block;

a cradle formed in said block for holding a roller chain during operation of the device;

a first bore extending from an exterior surface of said block to said cradle;

a first reciprocating means carried in said first bore operable for positively forcing a pin from a roller chain being held by said cradle;

a second bore extending from the exterior surface of said block to said cradle;

a second reciprocating means carried in said second bore operable for positively forcing a pin into a roller chain being held by said cradle;

a first opening in said block to facilitate removal of a pin being forced from a roller chain being held by said cradle; and a second opening in said block to interpose a pin between a roller chain being held by said cradle and said second reciprocating means.

2. A device as recited in claim 1, wherein said first bore is threaded and said first reciprocating means is a screw.

3. A device as recited in claim 1, wherein said first bore and said second bore are threaded, and said first reciprocating means and said second reciprocating means are screws.

4. A device as recited in claim 1, wherein said cradle is formed to provide substantially complete abutting support for an outer link plate through which a pin is to be removed from a roller chain being held by said cradle, thereby effectively countering forces which would otherwise tend to cause deformation of said outer link plate when a pin is forced therefrom.

5. A device as recited in claim 1, wherein said cradle is contoured to substantially conform to the shape of a roller chain.

6. A device as recited in claim 5, wherein said contoured cradle includes a plurality of teeth for projecting through the open areas between rollers of a roller chain.

7. A device as recited in claim 6 wherein said contoured cradle has six teeth.

8. A device for removing pins from a roller chain, comprising:

a block having a channel;

a removable cradle-insert positioned within said channel, said cradle-insert having a cradle for holding a roller chain during operation of the device;

a bore extending from an exterior surface of said block to said channel;

a second bore extending from said exterior surface of said block to said channel;

a first reciprocating means carried in said bore operable for positively forcing a first pin from a roller chain being held by said cradle;

a second reciprocating means, independent of said first reciprocating means, carried in said second bore operable for positively forcing a second pin, having a different size pin than that of said first pin, from a roller chain being held by said cradle; and an opening in said block to facilitate removal of a pin being forced from a roller chain being held by said cradle.

9. A device for removing pins from a roller chain, comprising:

a block;

a cradle formed in said block for holding a roller chain during operation of the device;

a first bore extending from an exterior surface of said block to said cradle;

a second bore extending from an exterior surface of said block to said cradle;

a first reciprocating means carried in said first bore operable for positively forcing a pin from a roller chain being held by said cradle;

a second reciprocating means carried in said second bore operable for positively forcing a pin into a roller chain being held by said cradle;

a first opening in said block to facilitate removal of a pin being forced from a roller chain being held by said cradle;

a second opening in said block to interpose a pin between a roller chain being held by said cradle and said second reciprocating means; and a groove in said second bore for aligning a pin placed on said groove with a pin opening of a roller chain held by said cradle.

10. A method for removing a pin and inserting a pin into a roller chain, comprising:

providing a device for removing a pin from a roller chain, said device comprising a base having a first bore, a second bore, a cradle having at least six teeth for holding a roller chain during operation, a first reciprocating means for positively forcing a pin from a roller chain being held by said cradle, a second reciprocating means for positively forcing a pin into a roller chain being held by said cradle, a first opening to facilitate removal of a pin being forced from a roller chain being held by said cradle, a second opening to interpose a pin between a roller chain being held by said cradle and said second reciprocating means, and a groove for aligning a pin with a pin opening of a roller chain held by said cradle;

providing a roller chain requiring the removal of a pin;

placing the first and second reciprocating means of said device so that no portion of said first and said second reciprocating means extends into said cradle;

placing said roller chain into the cradle of said device so that the roller from which a pin is to be removed is held between a second tooth and a third tooth of said device;

moving said first reciprocating means toward said cradle;

forcing a pin in the roller chain completely from the roller chain with said first reciprocating means;

placing a roller chain into said cradle with the pin opening within the roller chain in alignment with the second bore;

inserting a pin completely into said second opening and on said groove, said groove aligning the pin with the pin opening of the chain; forcing the pin completely into the pin opening of the roller chain by moving said second reciprocating means; and removing the roller chain from said cradle in which a pin has been inserted.

* * * * *